United States Patent [19]

Schultz

[11] Patent Number: 4,595,121

[45] Date of Patent: Jun. 17, 1986

[54] APPARATUS AND METHOD FOR DISPENSING AND PRESERVING BOTTLED DEGRADABLE LIQUIDS SUCH AS WINE AND THE LIKE

[76] Inventor: Sheldon Schultz, 8415 Sugarman Dr., La Jolla, Calif. 92037

[21] Appl. No.: 737,562

[22] Filed: May 22, 1985

Related U.S. Application Data

[63] Continuation of Ser. No. 649,153, Sep. 10, 1984, abandoned, which is a continuation of Ser. No. 563,000, Dec. 16, 1983, abandoned, which is a continuation of Ser. No. 275,550, Jun. 19, 1981, abandoned, which is a continuation of Ser. No. 49,191, Jun. 18, 1979, abandoned.

[51] Int. Cl.[4] ..... B65D 83/14

[52] U.S. Cl. ..... 222/1; 222/399; 239/428.5; 116/DIG. 8

[58] Field of Search ..... 222/1, 399, 400.7; 116/220, DIG. 8; 239/428.5

[56] References Cited

U.S. PATENT DOCUMENTS

| | | | |
|---|---|---|---|
| 159,142 | 1/1875 | Baird | 239/428.5 X |
| 478,940 | 7/1892 | Ogram | 222/399 X |
| 609,970 | 8/1898 | Lochmann | 222/399 |
| 659,895 | 10/1900 | Peters | 222/399 |
| 2,326,641 | 8/1943 | Heeter et al. | 222/209 X |
| 2,342,940 | 2/1944 | Janke | 222/399 X |
| 3,556,356 | 1/1971 | Heilbronn et al. | 222/399 |
| 3,750,915 | 8/1973 | Kearney | 222/567 |
| 3,883,043 | 5/1975 | Lane | 222/399 |
| 4,011,971 | 3/1977 | Haydon | 222/399 |
| 4,185,638 | 1/1980 | Bruner | 116/DIG. 8 |

FOREIGN PATENT DOCUMENTS

| | | | |
|---|---|---|---|
| 8323 | 3/1894 | Switzerland | 222/399 |

OTHER PUBLICATIONS

Amerine, M. A.; Berg, H. W.; and Cruess, W. V.; *The Technology of Wine Making,* Conn. AVI Publishing Co., 1967, pp. 282, 283 and 471.

*Primary Examiner*—David A. Scherbel

*Attorney, Agent, or Firm*—Ronald E. Grubman; Joseph H. Smith

[57] ABSTRACT

An apparatus and method are provided for dispensing degradable beverages, such as wine, from a pressure-intolerant container such as a glass bottle, while insuring that gaseous contaminants such as oxygen cannot enter the bottle. In the system provided, a pressure-limiting gas container admits a non-degrading gas into the bottle under a safe dispensing pressure to dispense the beverage. The apparatus is configured (and the method steps are arranged) to insure that no pressure substantially higher than the dispensing pressure can ever be present in the bottle, even upon failure of any or all pressure-limiting elements in the system. Between dispensing episodes, air and other contaminants are excluded from the bottle by means of structure, including suitably arranged, quick-acting, self-closing valves.

16 Claims, 10 Drawing Figures

APPARATUS AND METHOD FOR DISPENSING AND PRESERVING BOTTLED DEGRADABLE LIQUIDS SUCH AS WINE AND THE LIKE

CROSS REFERENCE TO RELATED APPLICATION

This is a continuation of application Ser. No. 649,153 filed Sept. 10, 1984 now abandoned, which was a continuation of application Ser. No. 563,000 filed Dec. 16, 1983 now abandoned, which was a continuation of application Ser. No. 275,550 filed June 19, 1981, also now abandoned, which was a continuation of application Ser. No. 049,191 filed June 18, 1979, also now abandoned.

BACKGROUND OF THE INVENTION

In recent years there has been a great increase in wine consumption. As more people have become familiar with better quality wines, they have also become sensitive to the degradation which occurs when an open bottle of wine is recorked and reused at a later time. The problem appears to be that when a wine bottle is opened for an initial pouring, oxygen in the air enters the bottle and is trapped there when the bottle is recorked. The trapped oxygen apparently chemically interacts with the wine remaining in the bottle, causing changes in the taste, aroma, and color of the wine. Thus, when the bottle is reopened at a later date, the quality of the wine is found to be significantly degraded.

In some commercial wine handling processes it is known to transfer the wine from one container to another under the pressure of nitrogen gas admitted to the container. Reference to such a process is made in the textbook entitled, *Technology of Wine Making*, Second Edition, by Amerine, Berg, and Cruess. Additionally, there are available commercial devices for wine dispensing by bars which use high pressure nitrogen to drive the wine from a metal container to a dispensing tube at the bar. However, it does not appear that any satisfactory method or device is presently known which will allow safe dispensing of wine from a glass bottle, while preventing oxygen in the air from degrading the beverage both during dispensing and bottled storage between dispensing events.

In U.S. Pat. No. 3,750,915, issued to P. Kearny on Aug. 3, 1973, the problem of wine spoilage by air is addressed. Kearny disclosed a spout including a plug which prevents air from entering the bottle during storage periods. However, the spout is adapted to admit air during the pouring of the wine. This air will be trapped in the bottle during storage when it can chemically interact with the stored wine.

Recently, another device has been marketed in which wine is packaged not in a glass bottle, but in a plastic container having a dispensing spigot near the bottom. As the wine is dispensed from the spigot, atmospheric pressure collapses the plastic container in the region left empty by the poured wine. Since no air is admitted to the container at any time, no deterioration of the wine takes place during pouring or later storage. Although air is excluded by this method, it has been, and continues to be, the case that higher quality wines are bottled and corked in glass bottles, and are not made available in plastic dispensing containers.

SUMMARY OF THE INVENTION

In accordance with the illustrated preferred embodiments, the present invention provides an apparatus and method for dispensing degradable beverages, such as wine, from a pressure-intolerant container such as a glass bottle, while insuring that gaseous contaminants such as oxygen cannot enter the bottle. In the system, a non-degrading gas is allowed to flow into the bottle under a safe dispensing pressure through an inlet valve in a sealing cap. The gas entering the bottle provides pressure to force the beverage out of the bottle through another valve into a dispensing tube while excluding air and other contaminants from the bottle. During storage between dispensing events, air is still excluded from the bottle by means of structure including suitably arranged quick-acting self-closing valves. Spoilage of the beverage is therefore prevented.

In accordance with aspects of the invention, the apparatus is configured (and the method steps are arranged) to insure that the pressure in the bottle is never substantially higher than the dispensing pressure, even upon failure of any or all pressure-limiting elements incorporated in the system; explosion of the bottle by inadvertant admission of gas under high pressure is thereby prevented. In some preferred embodiments, a large volume of gas may be stored at high pressure in a suitable storage vessel of convenient size for repeated charging of the pressure-limiting container.

DETAILED DECRIPTION OF THE PREFERRED EMBODIMENT

Figure 1:
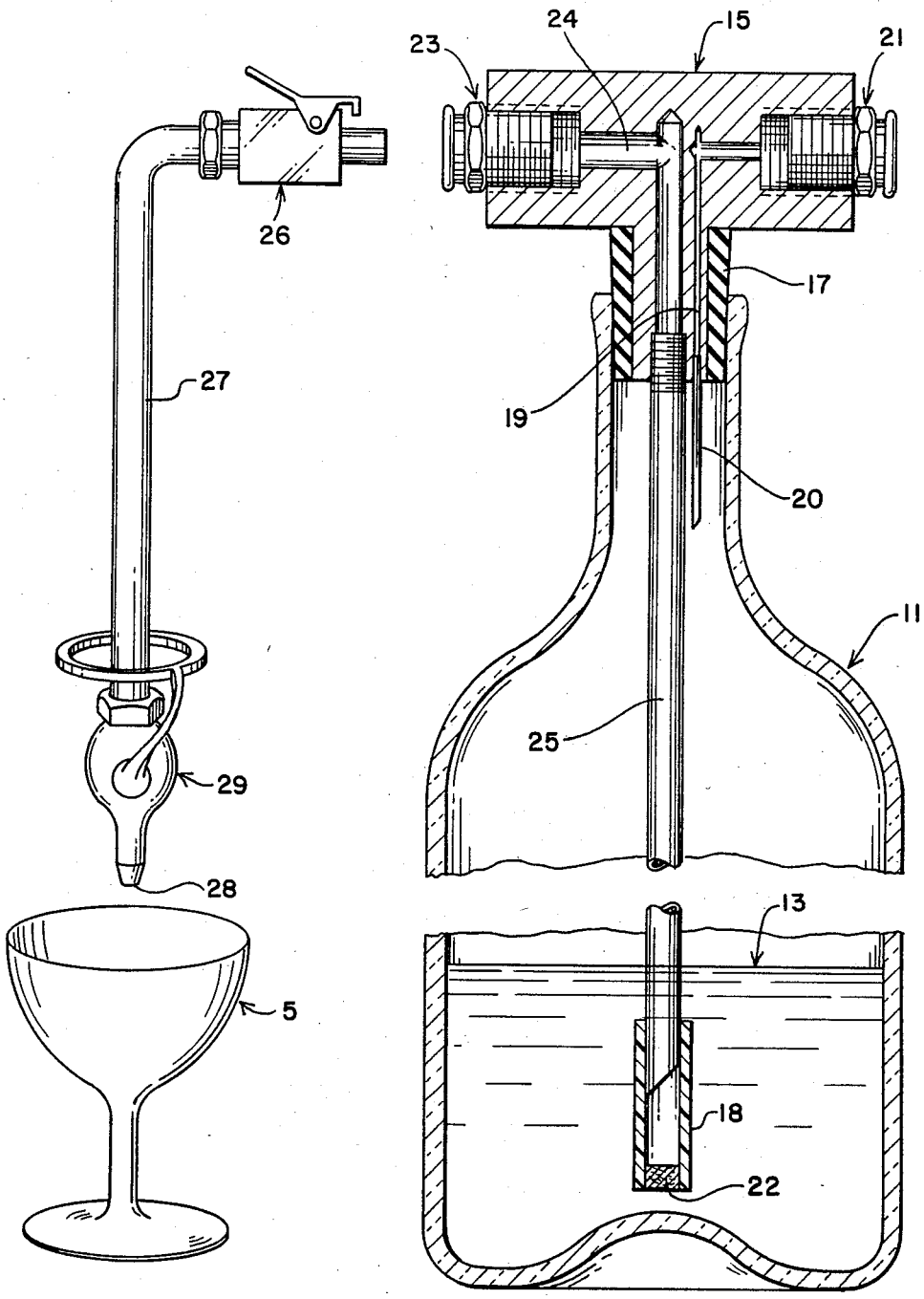
FIG. 1 shows a bottle containing a degradable beverage, the bottle having a cap and dispensing tube attached.

In the figures and detailed description, like numbers will be used to designate like elements in all figures. In FIG. 1, there is shown a pressure-intolerant beverage container 11, such as a glass bottle, partially filled with a degradable beverage 13. For purposes of this disclosure, a "degradable beverage" is taken to be a liquid intended for human consumption whose taste, color, appearance, or texture would be altered by contact with liquid or gaseous substances, including air or oxygen; in particular, a degradable beverage is meant to include wine.

A cap 15 is fitted into beverage container 11 by insertion of a sleeve 17, for example, of rubber. The sleeve should provide a goodness of seal with bottle 11 comparable to that provided by the cork (or other seal) originating with the bottle prior to its first being opened. A channel 19 extends downwardly through cap 15 into the upper region of bottle 11 (and may be extended to the liquid level by a tube 20). Channel 19 terminates in an inlet check valve 21. Another inlet check valve 23 provides external access to a tube 25 through a channel 24 in cap 15. Tube 25 makes a gas-tight seal to cap 15 (for example, in FIG. 1, tube 25 is shown as being threaded into cap 15) and extends downwards from cap 15 into the lower regions of bottle 11. In practice, valves 21 and 23 may be of different physical dimension to prevent inadvertent "backward" connection of the system. Extension pieces 18 may be provided for tube 25 to allow for bottles of differing depths, or to terminate beverage withdrawal at a desired level. Also, a suitable filter material may be incorporated within tube 25 or, as illustrated in FIG. 1, a suitable filter may be added to tube 25 to further remove undesired particulate matter, such as cork bits, from the beverage being dispensed. This permits dispensing and utilization of a maximal amount of the beverage, some of which would otherwise be less desirable for consumption.

Figure 2:
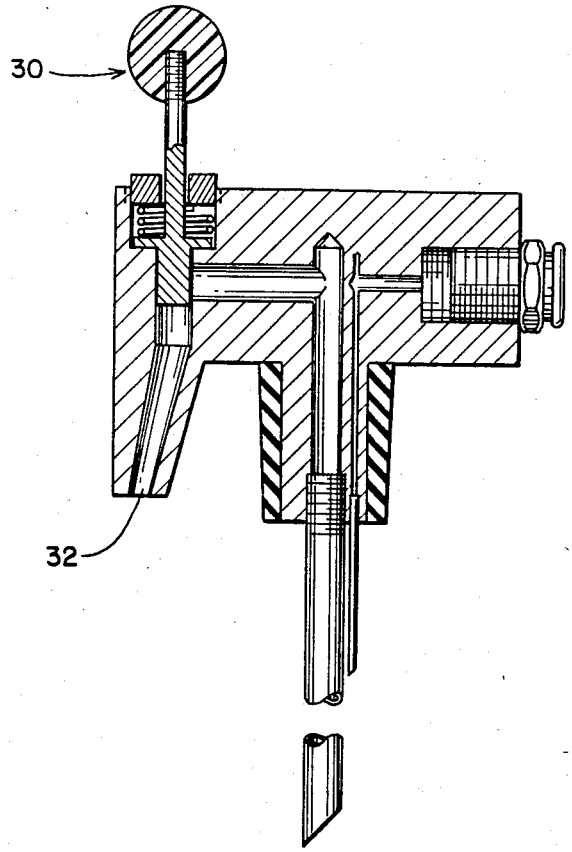
FIG. 2 illustrates a cap which, itself, incorporates a dispensing mechanism.

The upper end of a dispensing tube 27 terminates in a valve connection 26, such as a valve as adapted for insertion into inlet check valve 23. In a preferred embodiment, check valves 21 and 23 are of the "quick disconnecting" type such as model 298-PT available from Imperial Eastman Co. Dispensing tube 27 may therefore be rapidly engaged with or disengaged from cap 15 by simply pushing the units together or by pressing on a release lever and pulling the units apart. The lower end of tube 27 terminates in an opening 28 controlled by a manually-operated dispensing valve 29 mounted on tube 27. Valve 29 may be of the type operated by pressing on a lever such as a "no drip ®" dispenser faucet by Tomlinson Corp., or of other suitable types. Alternatively, cap 15 may be of the type shown in FIG. 2 in which dispensing is accomplished by means of a valve 30 and dispensing channel 32.

FIGS. 3, 4, 5, and 6 illustrate various aspects of the invention associated with the introduction of a "non-degrading gas" into bottle 11. For purposes of this disclosure, a non-degrading gas is a gas which does not dissolve in, or chemically or otherwise interact with, the degradable beverage in a manner which would degrade the taste, aroma, color, appearance, or texture of the degradable beverage. In particular, the gas should not contain free oxygen or air which could interact with and degrade the beverage. Some suitable gases are nitrogen, and the so-called chemically inert gases such as argon, neon, and helium.

Figure 3:
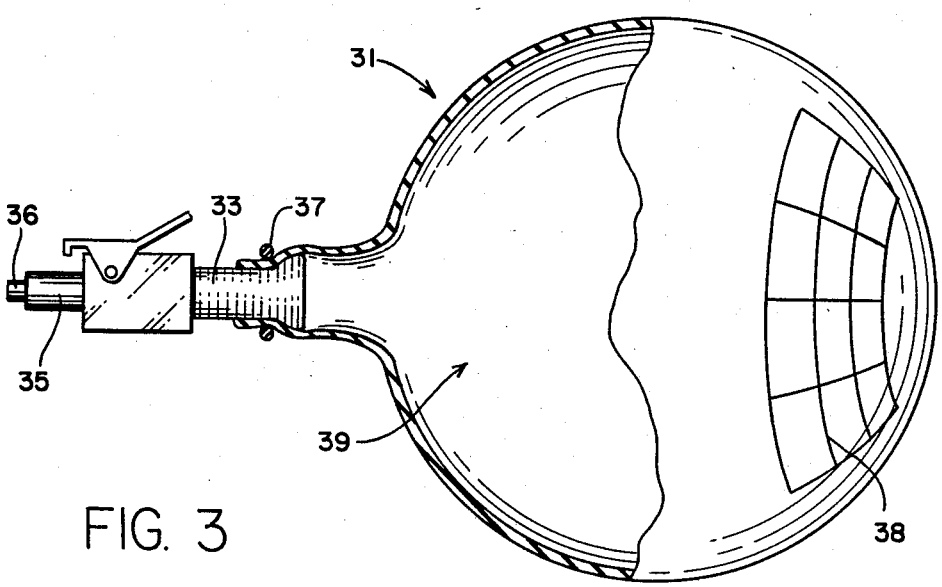
FIG. 3 shows a pressure-limiting gas container in the form of an elastic balloon.
Figure 5:
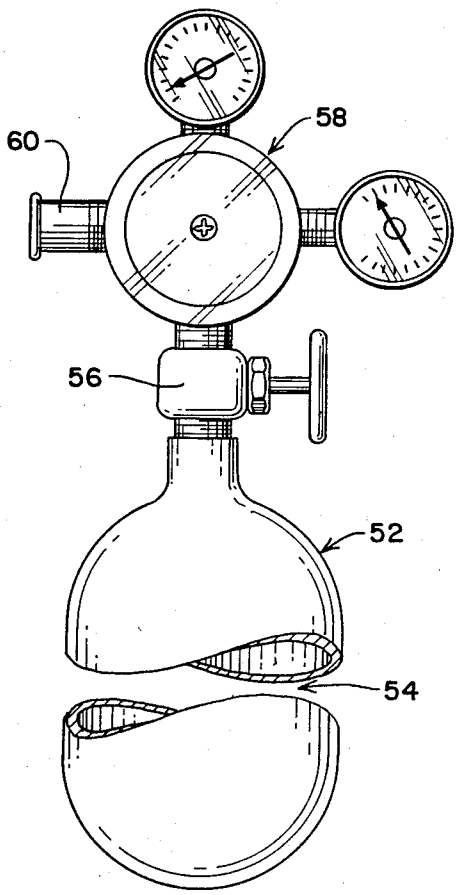
FIG. 5 shows a high-pressure container for storing a non-degrading gas for transfer to a pressure-limiting gas container.
Figure 6:
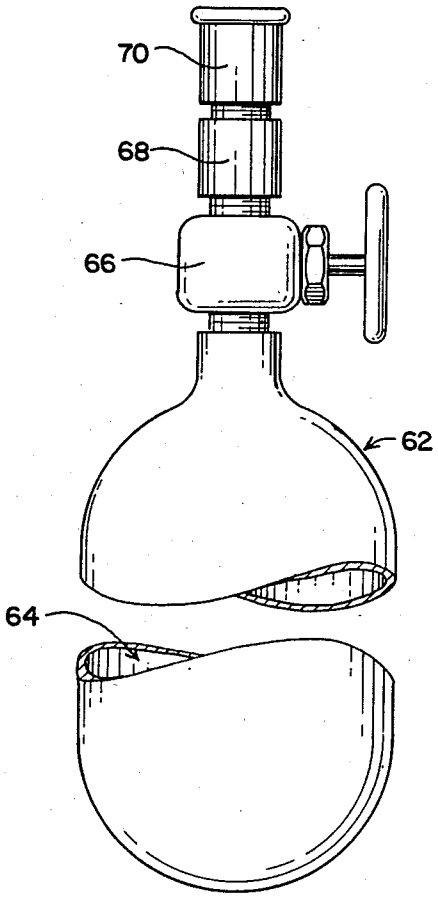
FIG. 6 shows another high pressure container for storing non-degrading gas for transfer to a pressure-limiting gas container.

Referring now to FIG. 3, a pressure-limiting gas container 31 (to be described more fully below) contains a supply of a non-degrading gas. Gas container 31 is connected to a valve insert 35, e.g. by a length of tubing 33. Valve insert 35 is insertable into inlet valve 21, and is preferably of the type known as "double ended" shut off, in that it contains an internal check valve which seals off any gaseous flow from container 31 upon disconnection from valve 21. Upon insertion into valve 21, both the check valves internal to valve 21 and insert 35 (the latter is opened, e.g. by means of a valve tip 36) are simultaneously opened insuring a free flow of gas from container 31 into channel 19 and thence into bottle 11. An example of such insert valve 35 is model 294-PMD made by Imperial Eastman. Tubing 33 makes an air tight seal with container 31, which may be faciliated by use of a flexible tensile element such as an O-ring 37.

Referring now specifically to pressure-limiting gas container 31, it is desirable that the container provide a steady flow of non-degrading gas 39 under a safe dispensing pressure via valve insert 35 to bottle 11. By a safe dispensing pressure is meant a pressure sufficiently high to provide dispensing of the beverage at a desired rate, but well below any pressure which would cause rupture, fragmentation, or explosion of bottle 11. For most wine bottles presently used, suitable dispensing pressures are in the range 0.5 psi to 2 psi with a preferred pressure being about 0.75 psi which provides a dispensing rate of about 0.3 liter of beverage per minute.

Figure 4:
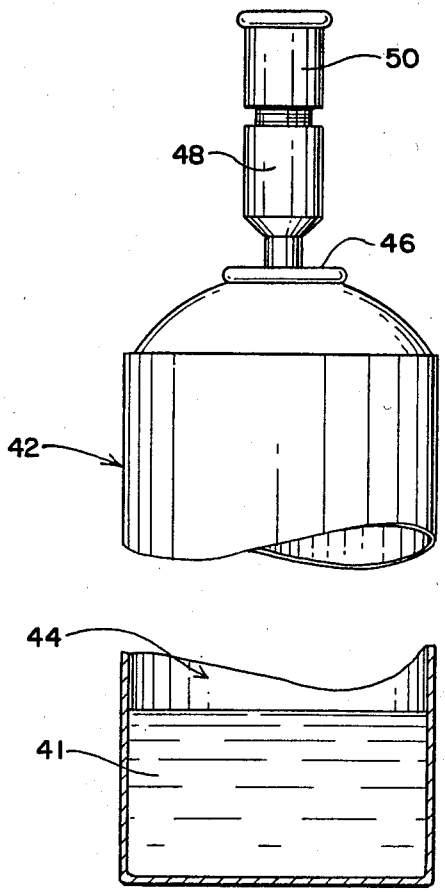
FIG. 4 illustrates a source of non-degrading gas utilizing the vapor pressure of a liquid.

Since the device is intended for routine consumer use, safety considerations are extremely important. In particular, the system should be constructed so that, even in the event of a catastrophic failure of all pressure-limiting elements in the system, no pressure substantially higher than the safe dispensing pressure will ever appear in bottle 11. Thus, preferred embodiments of the invention employ a pressure-limiting gas container 31 having elastic or deformable properties enabling non-degrading gas 39 to flow into bottle 11 under the requisite low pressure provided, e.g., by hand pressure, mechanical pressure, atmospheric pressure, or gravity. In one preferred embodiment of this type, gas container 31 may be an elastic balloon filled with a non-degrading gas 39. In alternative embodiments, the non-degrading gas may be stored at the safe dispensing pressure by condensation into a liquid, by adsorption, or by absorption of a suitable gas by a liquid, solid, matrix, substrate, or chemical substance. For example, FIG. 4 shows a container 42 in which a non-degrading gas 44 is derived from the vapor pressure of a suitable liquid 41. All of these embodiments share the characteristic that no pressure substantially higher than the safe dispensing pressure appears anywhere in the system which could be in communication with the bottle during dispensing or storage. Thus, even in the event of failure of any or all pressure-limiting elements in the system (e.g., explosion of elastic container 31 or a valve failure in container 42), no pressure substantially higher than the safe dispensing pressure will appear in the bottle.

It is contemplated that use of the invention will involve multiple dispensing events separated by storage periods of varying duration. It may therefore be desirable to store a large volume of non-degrading gas at high pressure, and to transfer some of the gas to a pressure-limiting gas container for each dispensing event. Thus, e.g., container 42 of FIG. 4 may contain a non-degrading gas 44 derived from the vapor pressure of a suitable liquid 41 having a high vapor pressure. In containers 52 and 62 of FIGS. 5 and 6, a non-degrading gas 54 or 64 may be simply compressed and stored at high pressure as is conventionally known (note that the high-pressure container may also be of the structural type shown in FIG. 4). Alternatively, the gas may be stored at high pressure by condensation into a liquid by adsorption, or by absorption of a suitable gas by a liquid, solid, matrix, substrate, or chemical substance.

To fill pressure-limiting gas container 31, the non-degrading gas 44, 54, or 64 is controllably transferred from container 42, 52, or 62 by insertion of insert 35 into termination 50, 60, or 70 and activation of valve 46, 56, or 66. The flow of gas and the pressure at the output 50, 60, or 70 is regulated using either a pressure regulator 58 such as Model GW-6-3-10 made by Marquett Corp. or a flow restrictor 48 or 68. The termination 50, 60, or 70 matches insert 35 and may or may not be of the type containing its own internal check valve. In all cases, it does allow for opening the valve internal to insert 35, e.g., by means of valve tip 36. If a variable pressure regulator is utilized for regulator 58, it may be adjusted to vary the desired rate of flow of gas entering container 31. If termination, 50, 60, or 70 does not include an internal check valve, then valve 46, 56, or 66 would be actuated just prior to insertion of insert 30 so as to flush out any air contained within gas container 31. If termination 50, 60, or 70 is equipped with an internal check valve, insert 35 may simply be plugged in directly and in some circumstances valve 46, 56, or 66 may be omitted; such a valve is generally desirable, however, for use as a shut-off valve.

Valve tip 36 may also be manually activated thereby allowing gas contained within container 31 to be released at will. It is therefore possible to greatly reduce vestiges of oxygen or other undesired contaminants inside container 31 or the other components illustrated in FIG. 3 by repeated flushing, e.g., by the sequence: fill container 31 from container 42, 52, or 62, release gas to surrounding environment, refill container 31, etc. as desired. When container 31 has been adequately purged of all undesirable contaminants, it may be filled with gas to a desired amount and utilized to deliver the beverage in a manner to be described below. The desired amount may be indicated on container 31, e.g., in the case of an elastic balloon, the amount may be defined by the relative orientation of prescribed markings 38 on the balloon.

Figure 7:
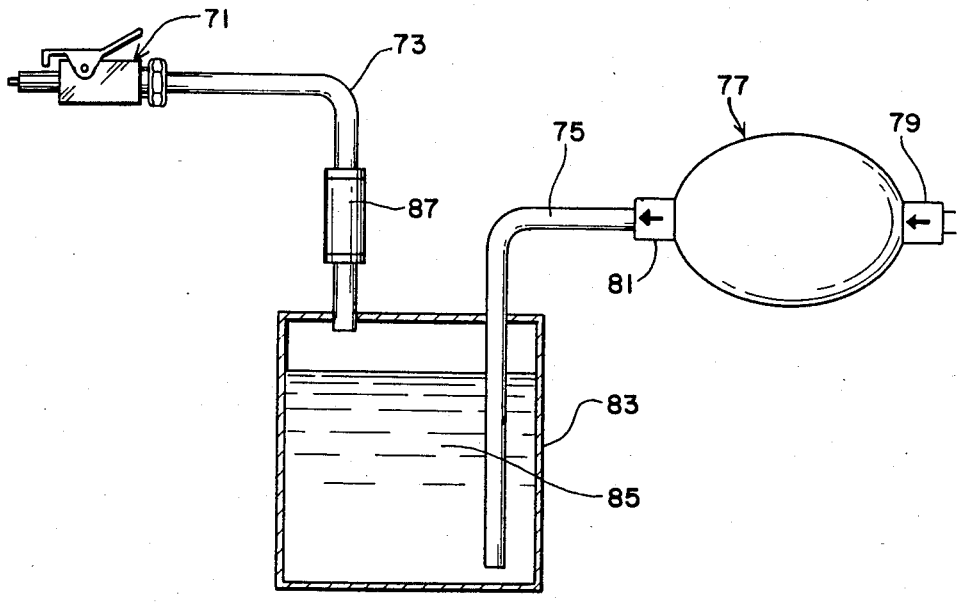
FIG. 7 illustrates another source of non-degrading gas utilizing chemical treatment of air.

In a further embodiment which may be employed to insure a supply of non-degrading gas, air may be processed in such a manner so as to satisfactorily remove or chemically alter the oxygen and any other undesirable contaminant present in the environment so that the processed gases may be utilized as the non-degrading gas of the invention. Referring to FIG. 7, air may be pumped or forced by manual action of an element 77 equipped with an inlet valve 79 and an outlet valve 81 through tube 75 into an air processing device in container 83. Internal to air processing device is a medium 85 which acts upon air to remove the oxygen and other contaminants or to modify the chemical or physical state of oxygen or such other contaminants as may be present in the air, so that the gases eminating from tube 73 via a termination 71 (which may be of the form of inlet insert 35 previously described) will be of such quality as to be deemed a non-degrading gas as heretofore defined. The device may also contain a suitable filtering medium or material 87 to further process the gases and to inhibit the passage of any other material contained within container 83 which may be deemed undesirable into exit tube 73. In a particular device of this kind, air is made to bubble through a fine porous glass frit into a solution of water and glucose containing an enzyme, glucose oxidase. Such enzyme and solution actively causes the binding of gaseous oxygen dissolved in such liquid so that the gases evolving after such treatment are substantially free of combinable oxygen. Other processing devices, known as "oxygen traps" may also be employed. It is also possible to incorporate filtering, absorbing, adsorbing, or related material commonly referred to as "getters" in conjunction with the various preferred embodiments heretofore described to further insure maximum reduction of oxygen and other contaminants that may be present in the gaseous or other material introduced into bottle 11 via inlet valve 21.

After the above-described processing has been done, the processed gas (now a non-degrading gas) may be forced via pressure from the manually activated pump to fill up container 31, for subsequent use as previously described. Alternatively, container 83 may, itself, be directly connected (via outlet termination 71) to bottle 11, thereby, itself, serving as a pressure-limiting gas container.

Figure 8:
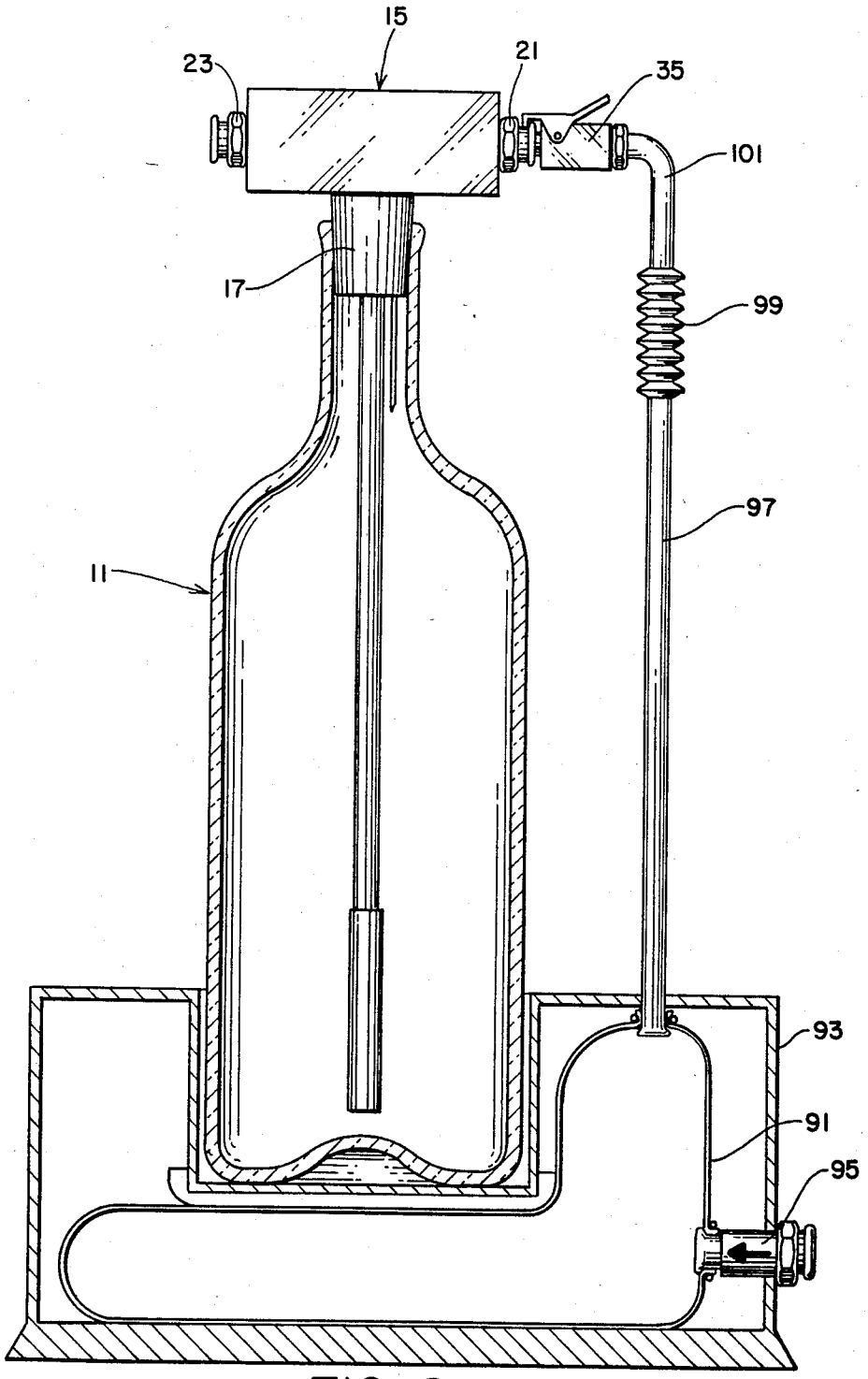
FIG. 8 shows a device in which the pressure-limiting gas container is housed in a base.

In FIG. 8, an alternate embodiment is shown in which the non-degrading gas to be utilized for forcing out the beverage is stored within the confines of a container that also serves to provide a stable base, thereby providing a convenient and aesthetic approach for gas storage. Bottle 11, sleeve 17, cap 15, inlet valve 21, outlet port valve 23, and inlet insert 35 are all similar to that previously described. The non-degrading gas is stored in a pressure-limiting container 91 which is located within a housing 93 which also serves as the base. Gas is admitted to container 91 through a check valve 95 from a suitable higher pressure storage source such as those shown in FIGS. 4, 5, and 6. Gas at the dispensing pressure leaves container 91 and flows through a tube 97, past a flexible coupling 99 and continuation tube 101 into cap 15 via the coupling pair of check valves 21 and 35 as previously described.

Operation of any of the above-described embodiments of the invention is substantially as follows: The original wine cork or stopper is first removed from bottle 11 in a conventional manner. Cap 15 and sleeve unit 17 are first loosely seated in bottle 11. Insert valve 35 is connected to inlet valve 21 permitting gas from the pressure-limiting gas container such as container 31, to flow under pressure into bottle 11, thereby forcing out any air which was initially let into the bottle upon decorking. During this procedure, cap 15 and sleeve 17 are gradually seated into bottle 11 effecting a gas-tight seal. After cap 15 is firmly seated as described, the dispensing assembly of FIG. 1 may be connected to cap 15 by connecting insert 26 to outlet check valve 23. The device is now ready for dispensing operations. To dispense wine from bottle 11 into a receptacle 5, it is only necessary to manually open dispensing valve 29. When valve 29 is opened, wine will automatically flow upward through tube 25 and thence through tube 27 into receptacle 5 under the continuous driving force supplied by gas pressure from container 31. Since the gas pressure everywhere in the system is greater than atmospheric pressure, at no time during operation, or storage, can air or other contaminants enter bottle 11 through any opening.

At any time when it is desired to store bottle 11 with its remaining contents of degradable beverage 13, it is convenient to remove the dispensing assembly by detaching insert 26 and removing the gas source assembly by detaching insert 35. The internal check valves contained in outlet 23 and inlet 21 will then instantly close shut. Bottle 11 is thereby sealed off from entry of air or other contaminants and may be stored as desired; for example, in a wine rack with the neck below the horizontal or in a refrigerator, in the case of a wine such as those usually called "white wines" where chilled storage is deemed desirable.

Yet, an additional benefit of the present invention may be noted. It is often the case that wines, particularly fine red wines, have a solid or particulate sedimentation accumulated in the bottle prior to its initial opening. When such wines are ported from the bottle, it is often the case that some of the sediment is inadvertently poured into the wine glass, thereby providing an unpleasant experience for the drinker. This problem is greatly reduced by the use of the present invention since dispensing of the wine is done with the bottle in the vertical position. Hence, the sediment may be allowed to settle to the bottom of the bottle prior to serving, and remain there during the dispensing process, never to find its way into the drinker's glass.

Figure 9:
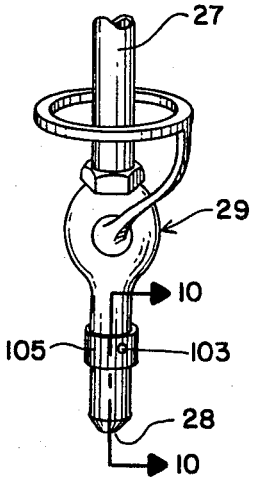
FIG. 9 shows a mechanism for aerating the beverage during dispensing.
Figure 10:
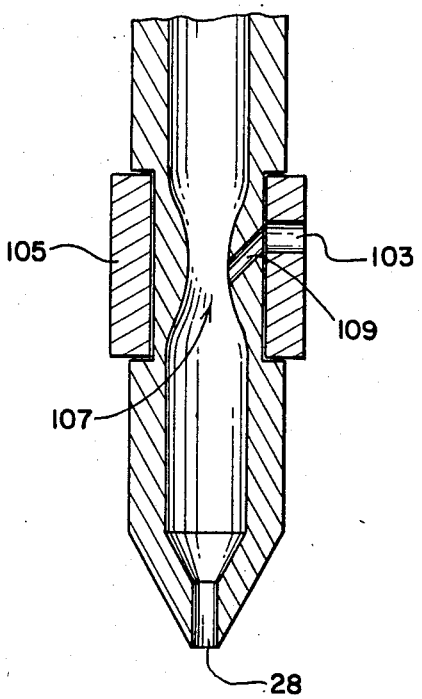
FIG. 10 is a cross-sectional view of the mechanism shown in FIG. 9.

In the case of some wines, in particular, red wines, it is thought that the flavor and aroma are enhanced if the wine is allowed to interact with air for an appropriate time just prior to drinking the wine, i.e., it is said that the wine should "breathe". In accordance with another embodiment shown in FIGS. 9 and 10, aeration of the wine may be accomplished as the wine is dispensed from tube 27. This aeration is provided for by incorporating an air inlet opening 103, and a closure mechanism means such as a ring 105 at the base of dispensing valve 29 and just prior to outlet 28. The passage inside the tube between valve 29 and outlet 28 is restricted in a manner referred to as a "Venturi" restriction 107. The fluid flow past the restricted region 107 results in a dimunition of pressure such that air would be forced through openings 103 and 109 to join the fluid, thereby increasing the opportunity for the fluid, e.g., wine, to "breath". However, since the wine is flowing out of the bottle 11 under pressure, still no air will flow back into bottle 11 to spoil any remaining wine which may be stored for later use. Ring 105 is rotated to isolate inlet 103 from inlet 109 when no aeration is desired. Alternatively to a "Venturi" restriction, an arrangement of nozzle and/or perferated plates or cylinders such as those commonly in use on water faucets may be incorporated to increase the aeration of the wine with the surrounding atmosphere.

I claim:

1. Apparatus for preventing spoilage of a degradable beverage during dispensing of the beverage from a glass bottle and during storage of the beverage in the bottle between dispensing events, comprising:

elastic balloon means for being filled with a non-degrading gas when said balloon means is not attached to said bottle in preparation for dispensing of said beverage, for attaching to said bottle to supply dispensing pressure during dispensing of said beverage, and for detaching from said bottle for storage of said bottle, said balloon means selected such that it will burst if said gas has a pressure that is above a preselected safe dispensing pressure for said bottle; and dispensing means for controllably dispensing the beverage from said bottle under the influence of said gas in said balloon means.

2. An apparatus as in claim 1 further comprising isolation means for excluding degrading gases and other contaminants from said bottle during dispensing of said beverage and during storage of said beverage in said bottle between dispensing events.

3. An apparatus as in claim 2 wherein said isolation means comprises:

cap means for sealing said bottle;

valve means for excluding degrading gases and other contaminants from said bottle during dispensing and when said balloon means is not attached to said bottle.

4. An apparatus as in claim 3 wherein said dispensing means comprises a dispensing valve in said cap.

5. An apparatus as in claim 4 wherein said dispensing means comprises conduit means between said beverage and said dispensing valve for moving beverage from inside said bottle to said dispensing valve.

6. An apparatus as in claim 5 wherein said dispensing means comprises aeration means for aerating said beverage as it is dispensed.

7. An apparatus as in claim 5 wherein said dispensing means comprises filter means for removing undesired matter from said beverage.

8. An apparatus as in claim 2 wherein said elastic balloon means comprises a balloon having an orifice for filling said balloon with said non-degrading gas.

9. An apparatus as in claim 8 wherein said dispensing means is adapted to receive said orifice of said balloon for attaching said balloon to said dispensing means.

10. An apparatus as in claim 9 wherein said gas in said balloon is the only supply of dispensing pressure.

11. An apparatus as in claim 9 further comprising high pressure gas storage and transfer means for filling said balloon from said orifice when said orifice is not attached to said dispensing means.

12. An apparatus as in claim 8 wherein the balloon is attached to the dispensing means in a manner which does not limit the volume of the balloon.

13. A method for preventing spoilage of a degradable beverage during dispensing of the beverage from a glass bottle and during storage of the beverage in the bottle between dispensing events, comprising the steps of:

(1) admitting a non-degrading gas from a high pressure supply into an elastic balloon which will burst if said gas in said balloon has a pressure above a pre-selected safe dispensing pressure for said bottle;

(2) after step (1), disconnecting said balloon from said gas supply;

(3) after step (2), connecting said balloon to said bottle;

(4) admitting said gas from said balloon under its own pressure from said balloon into said bottle; and (5) controllably dispensing the beverage from said bottle using the pressure caused by introducing gas from said balloon into said bottle.

14. The method of claim 13 further comprising the step of excluding degrading gases and other contaminants from the bottle during said controllable dispensing of the beverage and during storage of the beverage in the bottle between dispensing events.

15. The method of claim 14 comprising the step of purging said bottle of degrading gases prior to dispensing beverage from said bottle.

16. The method of claim 14 comprising the step of purging said balloon of degrading gases prior to filling with a non-degrading gas.

* * * * *